United States Patent [19]

Beck

[11] 4,011,395

[45] Mar. 8, 1977

[54] ELECTRIC FURNACE HEATER

[75] Inventor: Jacob Howard Beck, Waban, Mass.

[73] Assignee: BTU Engineering Company, North Billerica, Mass.

[22] Filed: Sept. 15, 1975

[21] Appl. No.: 613,416

[52] U.S. Cl. ..... 13/25; 219/532; 338/279; 338/283

[51] Int. Cl.[2] ..... H05B 3/06

[58] Field of Search ..... 13/25; 338/279, 280, 338/283, 287, 291; 219/552, 553, 532

[56] References Cited

UNITED STATES PATENTS

| | | | |
|---|---|---|---|
| 1,432,442 | 10/1922 | Collins | 13/25 |
| 1,719,888 | 7/1929 | Ipsen | 13/25 |
| 1,872,942 | 8/1932 | Hanson | 13/25 |
| 2,277,912 | 3/1942 | Johnson et al. | 338/280 |
| 3,697,923 | 10/1972 | Griffes | 338/280 |

*Primary Examiner*—R. N. Envall, Jr.
*Attorney, Agent, or Firm*—Weingarten, Maxham & Schurgin

[57] ABSTRACT

A generally rectangular, self-supporting, unitary high temperature electrical resistance heater adapted for generally horizontal suspension within a high temperature furnace in which the heating element is composed of a flat resistor ribbon folded to form a series of continuous and substantially parallel beam-like heater segments disposed in grate-like fashion. The ribbon heater segments are retained in their parallel configuration by a plurality of refractory insulators disposed between and supported solely by the beam-like segments. The resulting furnace heater offers advantages of light weight, high radiation efficiency and minimum thermal inertia.

10 Claims, 3 Drawing Figures

Fig. 1.
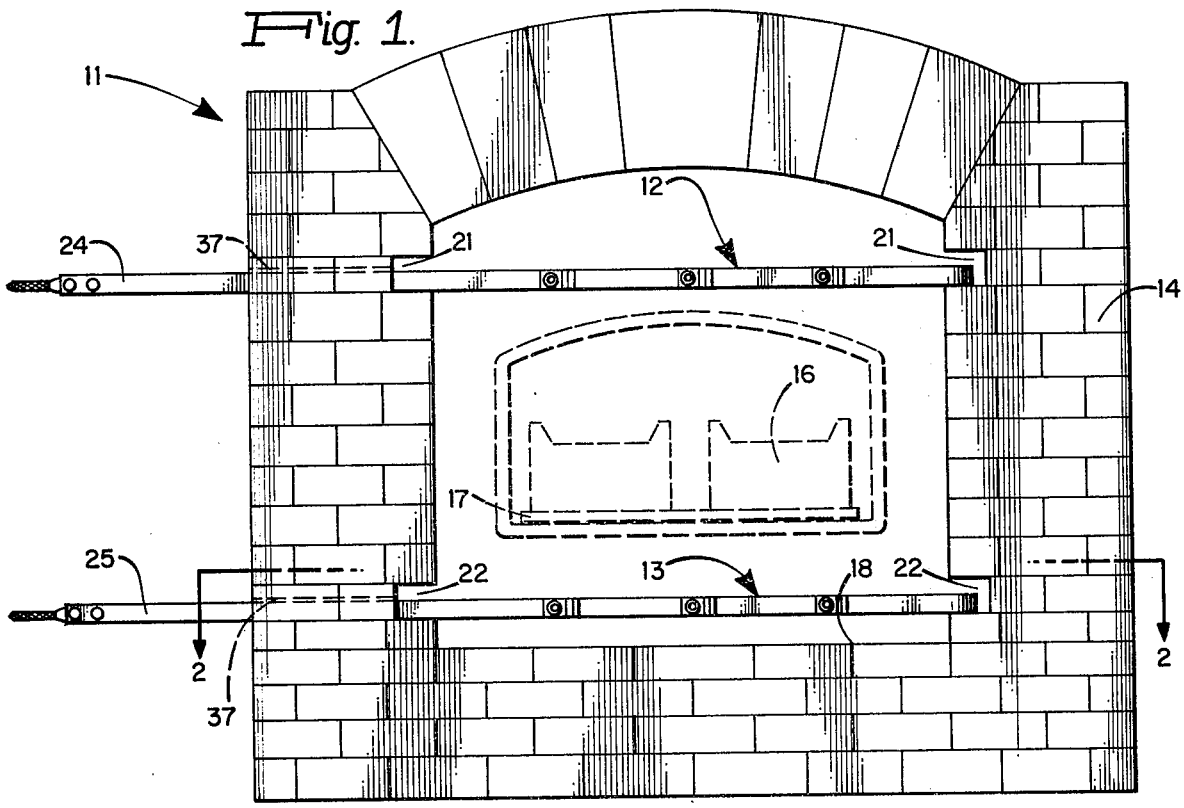
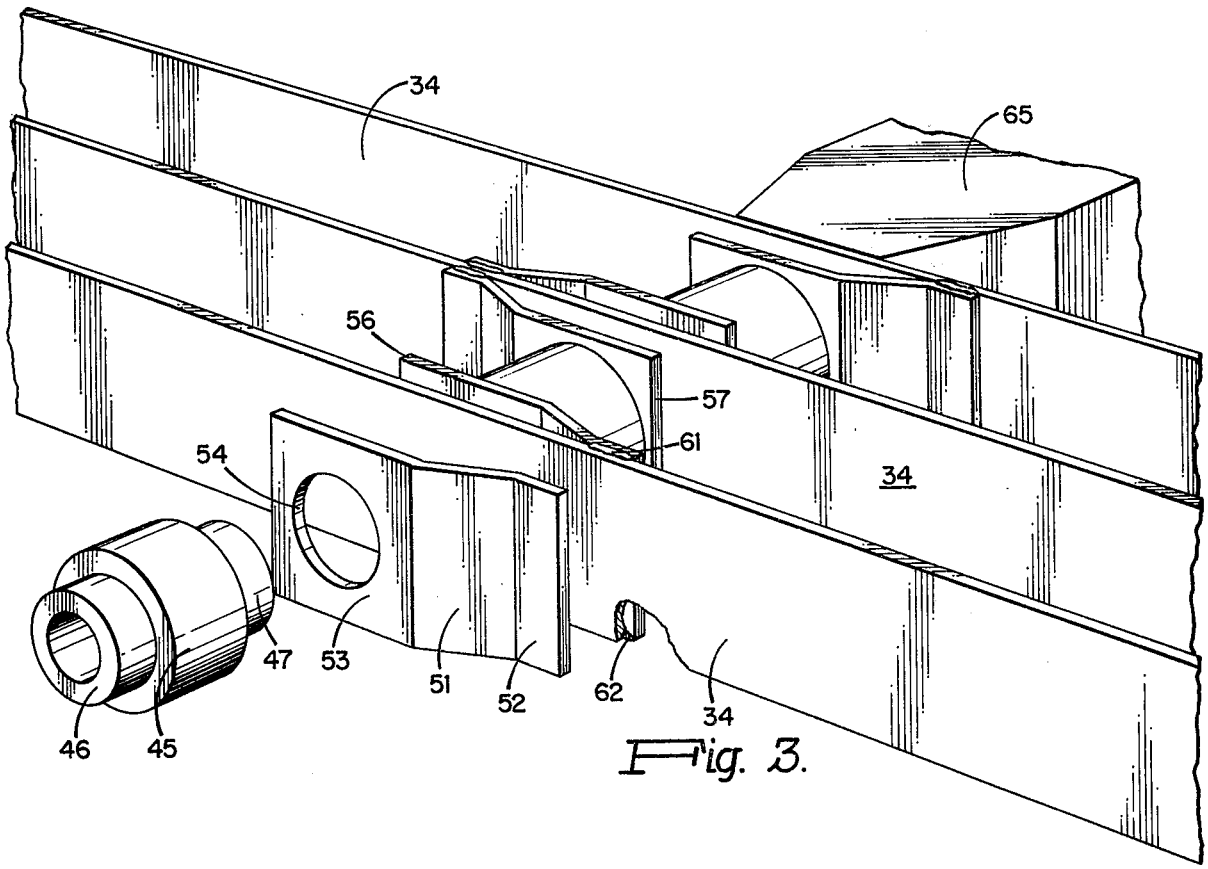
Fig. 3.

ELECTRIC FURNACE HEATER

FIELD OF THE INVENTION

This invention relates in general to heating elements for exceedingly high temperature electrical furnaces, and more particularly to a generally rectangular self-supporting electrical resistance heater formed of a continuous elongated flat resistor ribbon folded to define a large number of parallel beam-like segments spaced and maintained in rigid form by refractory means supported on said ribbon.

BACKGROUND OF THE INVENTION

In electrical furnaces employed in the heat processing of materials and products at exceedingly high temperatures, for example, temperatures up to 1900° C, heating coils are typically supported by ceramic cores such as grooved plates or cylinders. One such configuration is shown in U.S. Pat. No. 3,846,621. The use of ceramic cores, however, imposes a significant limitation in the length of span of such members. Moreover, the ceramic cores are by their nature dense material, with low tensile strength and subject to spalling and fracture at high temperatures. These cores are ordinarily placed above the produce because if placed below the product the cores invariably collect metallic oxides which eventually short-circuit the lower element. Generally, due to the amount of ceramic necessary, and the density of such material, the weight of the ceramic constitutes approximately 75% of the heating assembly. As a result of such massive amount of ceramic, the system develops a high thermal inertia which requires considerable time when the furnace undergoes a required change of state such as cooling or heating.

The function of the ceramic core in each of these prior heaters is to support and contain the electrical heating element. The core may be composed of a cylindrical rod or a circular or rectangular plate having a plurality of longitudinal re-entrant slots or grooves formed in the peripheral surface thereof and running the length of said surface. These grooves, due to the limitations imposed by the ceramic material, are necessarily of small diameter and will expose at the maximum one fifth the surface area of the electrical heating element itself. The shape of the heating element inserted into each groove is a function of the shape of its respective groove and thus normally helical in form. The ceramic core therefore effectively shades at least 80% of the direct radiation emitted by the coil to the product, thus providing a low standard of emissitivity. This low emissitivity in turn promotes a substantial differential in temperature between the product and the heating element, causing ineffiiciency and shorter heater life.

There are many other problems with heater coils set in grooves. When using flat ceramic plate with a plurality of longitudinal parallel grooves formed in the plane of one surface, and placed above and below the materials and product being heated, the lower flat heater collects particles which must be cleaned or the heater will short-circuit. The use of large amounts of ceramic material, small restraining grooves and relatively thin heating wire combine to yield poor tensile strength, an inefficient level of thermal inertia and a large temperature differential between the heater and the product.

Many other heater configurations have been used, some of which avoid the use of ceramic cores, as for example solid heater rods. The latter are limited however, in temperature range because at high temperatures the rod will sag and be unable to sustain their own weight for any appreciable length.

Heaters have been devised which use, to some extent, self-supportive, resistor elements, but these have been limited chiefly to low temperature applications such as hot-air heaters in duct-work and the like. Examples of such prior devices are shown in U.S. Pats. Nos. 3,651,304; 3,673,387 and 3,798,417.

These devices would however be wholly impractical at high temperatures in the region of 700°–900 ° C since the lack of support would cause the resistor elements to collapse entirely or at least sag to a non-useful configuration. In short, it has not previously been possible to provide an electrical high temperature furnace heater having a large area capable of being suspended without conventional heavy and relatively costly ceramic structures.

SUMMARY OF THE INVENTION

The present invention has a primary object the provision of a light weight high temperature electrical furnace heating element which is essentially self-supporting over a substantial area at operating temperatures where conventional elements would be incapable of support without auxilliary structures such as ceramic cores.

Broadly speaking, the furnace heater of this invention comprises a generally rectangular structure formed of a flat continuous electrical resistor ribbon folded back-and-forth upon itself to provide a planar grate-like configuration of spaced longitudinal beam-like heater segments, the flat faces of the ribbon being generally vertical and parallel one to the other. A large number of light weight refractory elements such as ceramic spools are supported solely on the resistor ribbon segments and are arranged to space these by an appropriate distance while providing lateral support served to create a unitary large-area structure which will retain its shape at the high temperatures contemplated.

The heater ribbon and the ceramic spacers are all readily and inexpensively assembled for insertion into the furnace where it rests on the folded edge portions of the ribbon. By virtue of the entirely open nature of the heater and the absence of enclosing ceramic cores, emissivity is increased and thermal inertia is reduced to a minimum. Apart from this increase in radiation efficiency, the open spaced vertical heater ribbons prevent accumulation of extraneous materials so that the heater functions equally above or below the product being processed.

The invention offers numerous additional advantages over the prior art. Fracture of the heating element is virtually precluded assuring long life. The ceramic material used in the structure need not be more than 5–10 percent of the total weight, which minimizes thermal inertia and increases radiation efficiency. These features, in turn, combine to lower the energy requirements and enhance the operational efficiency when incorporated into a high temperature furnace.

DESCRIPTION OF THE DRAWINGS

The invention will be more fully understood from the following detailed description taken in conjunction with the accompanying drawings in which:

FIG. 1 is a general diagrammatic representation of a furnace showing heating elements constructed according to the invention support therein;

FIG. 3 is a fragmentary cutaway side view of the heater of FIG. 1 depicting various specific parts of the assembly.

DESCRIPTION OF THE PREFERRED EMBODIMENT

Figure 2:
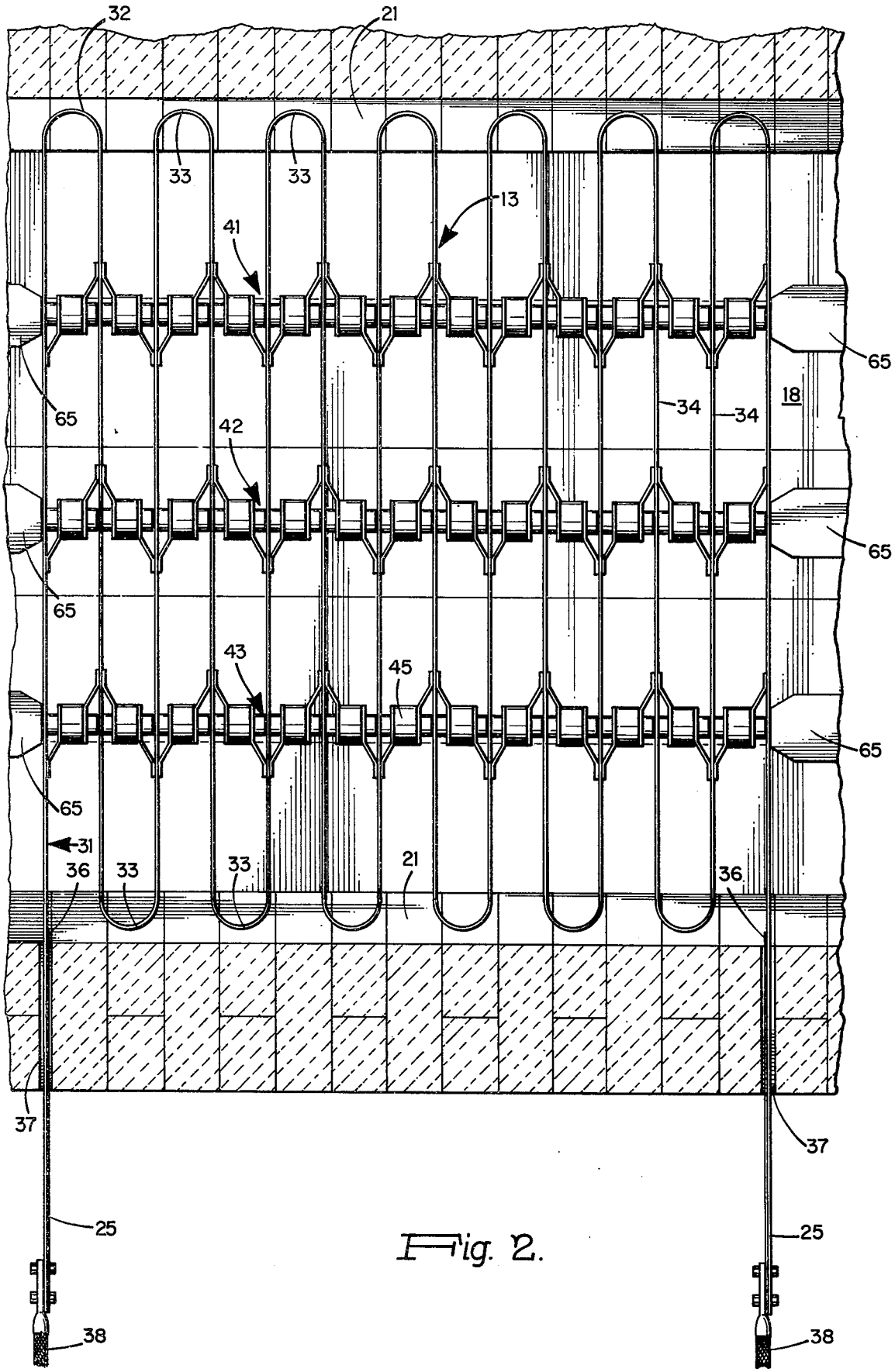
FIG. 2 is a plan view of heater assembly as viewed in the place 2—2 of FIg. 1.

With reference now to the drawings and more particularly to FIG. 1 where is shown a diagrammatic cross-section of furnace 11 incorporating two of the electrical furnace heating elements 12 and 13 in accordance with the principles of the present invention. Typically the furnace is assembled of appropriate fire brick 14 and encloses an elongated muffle 15 of quartz or the like material through which the product 16 being processed is transported on conveyor 17. Muffle 15 is retained at a position above the furnace floor 18 by a series of supports (not shown). The details of the muffle, product and conveyor have been purposely omitted for clarity since these do not form part of the present invention. Similarly omitted are supports for muffle 15.

As will be described in greater detail below, the heater elements 12 and 13 are generally planar rectangular structures, the longitudinal edges of which are supported in respective recesses 21—21 and 22—22 in the fire brick structure of the furnace. The lower heater element 13 is positioned above the furnace floor 18 providing a void space for the collection of debris. Thus as may be seen the heaters 12 and 13 are respectively above and below the muffle containing the product being treated. The outer ends of each heater 12 and 13 extend outwardly of the furnace as shown in FIGS. 1 and 3 and terminate in terminals 24—24 and 25—25 respectively, to which electric cables from an external electric power source (not shown) may be connected to energize the heaters.

The details of the heater 13 are shown best in FIGS. 2 and 3 and reference is now made thereto. More specifically, the heater 13 is seen to comprise a continuous flat metal resistor ribbon 31 folded repetitively at curves such as 32 and 33 on opposite ends thereof to provide a sinuous planar arrangement having a large number of parallel spaced longitudinal beam-like heater segments 34 each having parallel flat vertical confronting surfaces. By virtue of the large number of repetitive folds in the resistor ribbon and the spacing of the beam-like segments, a correspondingly large rectangular area is embraced by the heater between terminals 25—25. Heater elements 12 and 13 are typically formed from a nickel iron chrome alloy or iron chrome aluminum alloy when used for moderate heating temperatures and from molylbdenum or tungsten refractory metals when used for extremely high heating temperatures. As is evident from FIG. 2 each of the terminal ends 25 is constituted not only of the continuous end portions of metal resistor ribbon 31 but also welded additional conductive elements 36 which lower the resistance in these areas. Thus in the regions 37—37 where the ends of the heater pass through the furnace wall, the element remains cool and prevents damage and unnecessary dissipation of heat outside the furnace. The electric cables 38—38 are appropriately bolted to the double thickness terminals 25—25 for connection to the external power source.

The sinuous electric heater 13 is assembled into a grate-like structure in a manner that will now be described in detail with reference to both FIGS. 2 and 3. As is shown, the heater is formed with three transverse rows 41, 42 and 43 of spacers, the number of rows depending upon the relative overall size of the heater and more particularly the span of the individual heater segments 34 between the recesses 21—21 in the fire brick.

Each of the spacers in the transverse rows 41, 42 and 43 is comprised as is best shown in FIG. 3 of a small ceramic electrically insulative cylindrical spool 45 having reduced diameter cylindrical ends 46 and 47. The spool is hollow as shown to minimize weight. In FIG. 3 a typical bracket support 51 is shown prior to attachment to its respective beam-like heater segment 34 and is seen to comprise a strip of material formed of the same metal as resistor element 34 and of equal vertical height. Each bracket is folded to provide an inner portion 52 and a spaced outer portion 53, the latter being formed with circular opening 54 attached to receive the reduced diameter cylinder 47 of spool 45. As is also shown best in FIG. 3, brackets such as 56 and 57 are welded in pairs to respective confronting surfaces of the beam-like heater segments 34 with all of the circular openings 54 in axial alignment to provide the transverse rows shown in FIG. 2. More specifically, it will be noted that brackets such as 56 and 57 are welded only along the upper and lower edges as at 61 and 62, thus minimizing any change in electrical characteristics that the welding might otherwise cause in the heater segments 34.

As is best seen in FIG. 2 each of the spools 45 when inserted within the openings 54 of its respective adjacent pair of brackets, fits so that the outer flat surfaces of the spool contact the respective ribbon heater segments 34. When all of the spools 45 and all of the welded brackets are assembled as in FIG. 2, each of the transverse rows 41, 42 and 43 is totally compacted, thus providing a rigid unitary grate-like appearance for the heater.

During the course of assembly of the heater 13 the heater ribbon, due to its flexibility, may be pulled open to permit insertion of each of the spools 45 with ease. The final assembly may then be taped transversely (not shown) to retain the heater in positiion shown for insertion in the furnace. As is illustrated more clearly in FIGS. 2 and 3 lateral movement at transverse rows 41, 42 and 43 is prevented by a cross-member (not shown) having an appropriate number of projecting stops 65. When the heater is installed it is retained in the position shown in FIG. 2, and when first used the tape previously mentioned is burned away.

With reference to FIG. 1 and 2 it will be observed that heater elements 12 and 13 are freely suspended and are supported only at the rounded edges 32 and 33 within the recesses 21—21 and 22—22 respectively. The stops 65 do not provide support but as noted above prevent lateral separation of transverse rows 41, 42 and 43. When energized electrically and brought to the exceedingly high temperatures of operation capable of this heater, the ribbon segments 34 will expand and lengthen as is obvious. However, each heater segment 34 will maintain its vertical beam-like characteristics and thus be restrained from sagging, bending, twisting or buckling.

It should be further observed that the hollow spools 45 constitute the only refractory material within the heater and it is self-evident this constitutes a relatively small fraction of the total heater mass. The hollow spools 45 are typically formed from mullite for operating temperatures up to 1500° C and from high purity alumina or other suitable ceramic material for temperatures greater than 1500° C. Each of the surfaces of heater segments 34 is open to the product 16, and not shaded by any significant amount of ceramic, thereby significantly enhancing the emission characteristics of the heater in relation to the work being processed. In addition, the small amount of refractory material within the heater results in a structure with exceedingly low thermal inertia; thus if the product 16 in FIG. 1 tends to cool the furnace, the temperature is restored rapidly without the necessity of first heating a significant quantity of ceramic. It should also be observed that the open grate-like structure of the vertical heater segments 34 will prevent the accumulation of debris dropped from above. Thus when used in a furnace without a muffle, the lower heater 13 will not accumulate debris which will ultimately result in failure or short-circuit.

It will be apparent to those skilled in the art that the principles of this invention may be embodied in different configurations to suit particular heating processing requirements for furnace designs. Accordingly the invention should be deemed to be of the scope defined by the appended claims.

What is claimed is:

1. A generally rectangular, grate-like high temperature, self-supporting electrical resistance heater adapted for generally horizontal suspension within a high temperature furnace comprising:

an elongated flat continuous resistor ribbon folded to provide a sinuous planar arrangement of a plurality of spaced longitudinal beam-like heater segments having substantially parallel flat vertical confronting surfaces;

a plurality of physically distinct refractory insulators at least one of each disposed between confronting parallel surfaces of a respective pair of adjacent beam-like heater segments and supported solely on said resistor ribbon for spacing said respective confronting surfaces one from the other, said refractory insulators maintaining said beam-like heater segments in said parallel relationship throughout the operating temperature range of said high temperature heater;

means on said beam-like heater segments for supporting said refractory insulators between confronting parallel surfaces of adjacent heater segments; and electrical connecting means for connection of the respective outer ends of said continuous resistor ribbon to an external electrical power source.

2. The self-supporting electrical resistance heater of claim 2 wherein:

said refractory insulators are disposed in at least one row transverse to said beam-like heater segments.

3. The self-supporting electrical resistance heater of claim 2 wherein:

said refractory insulators in said transverse row are each maintained in firm surface contact with respective confronting parallel surfaces of said beam-like heater segments.

4. The self-supporting electrical resistance heater of claim 1 wherein:

said means for supporting each of said refractory insulators on said beam-like heater segments comprises a pair of support brackets each rigidly attached to and spaced from the respective confronting vertical surfaces of an adjacent pair of said heater segments;

said refractory insulators being supported between a respective pair of said brackets.

5. The self-supporting electrical resistance heater of claim 4 wherein:

each of said brackets is formed of sections of material comparable to said resistor ribbon, said brackets being secured to said beam-like segments substantially without effect on the resistive characteristics of said heater segments;

said brackets each being formed to fit and retain said refractory insulators.

6. The self-supporting electrical resistance heater of claim 5 wherein:

each of said refractory insulators comprises a generally cylindrical spool having reduced diameter cylindrical ends;

said reduced diameter ends fitting within and extending through said openings in said brackets with the end faces of said spools in surface contact with said confronting vertical faces of said beam-like heater segments.

7. The self-supporting electrical resistance heater of claim 5 wherein:

said brackets are each of the same vertical heights as said ribbon heater and are each welded thereto solely along the horizontal edges thereof.

8. The self-supporting electrical resistance heater in claim 1 wherein:

said refractory insulators are disposed in a plurality of substantially parallel rows transverse to said beam-like heater segments.

9. The self-supporting electrical resistance heater as in claim 7 wherein:

said brackets and said refractory spools supported therein are disposed in a plurality of substantialy parallel rows transverse to said beam-like heater segments;

said heater being adapted to be supported within a furnace along the folded ends of said resistor ribbon, and being further adapted to be fitted between means precluding transverse movement of each of said rows of refractory insulators.

10. The self-supporting electrical resistance heater of claim 1 wherein:

said plurality of refractory insulators are of total weight substantially less then the total weight of said resistor ribbon to minimize thermal inertia and increase radiation efficiency.

* * * * *

UNITED STATES PATENT AND TRADEMARK OFFICE

CERTIFICATE OF CORRECTION

PATENT NO. : 4,011,395

DATED : March 8, 1977

INVENTOR(S) : Jacob Howard Beck

It is certified that error appears in the above-identified patent and that said Letters Patent are hereby corrected as shown below:

Column 1, line 25, "produce" should read --product--.
Column 2, line 11, "700°-900°C" should read --700°-1900°C--.
Column 3, line 5, "FIg." should read --Fig.--.
Column 4, line 46, "positiion" should read --position--.
Column 5, line 57, "claim 2" should read --claim 1--;

Column 6, line 39, "in" should read --of--.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*